US008651763B2

(12) United States Patent
Byun

(10) Patent No.: US 8,651,763 B2
(45) Date of Patent: Feb. 18, 2014

(54) POWDER COSMETIC BRUSH

(76) Inventor: Young-Kwang Byun, Seoul (KR)

( * ) Notice: Subject to any disclaimer, the term of this patent is extended or adjusted under 35 U.S.C. 154(b) by 0 days.

(21) Appl. No.: 13/364,902

(22) Filed: Feb. 2, 2012

(65) Prior Publication Data

US 2013/0121752 A1 May 16, 2013

(30) Foreign Application Priority Data

Nov. 15, 2011 (KR) ..... 10-2011-0119030

(51) Int. Cl.
*A46B 11/04* (2006.01)

(52) U.S. Cl.
USPC ..... 401/281; 401/268; 401/280; 401/269; 401/283

(58) Field of Classification Search
USPC ..... 401/269, 268, 270, 281, 283; 132/299
See application file for complete search history.

(56) References Cited

U.S. PATENT DOCUMENTS

| | | | | |
|---|---|---|---|---|
| 1,889,446 | A * | 11/1932 | Lysons | 401/280 |
| 4,944,625 | A * | 7/1990 | Futter et al. | 401/153 |
| 6,457,891 | B1 * | 10/2002 | Bredacts | 401/280 |
| 6,932,533 | B1 * | 8/2005 | Chen | 401/281 |
| 6,935,802 | B1 | 8/2005 | Byun | |
| 7,669,606 | B2 * | 3/2010 | Byun | 132/299 |
| 7,794,168 | B2 * | 9/2010 | Chang | 401/280 |
| 8,277,139 | B1 * | 10/2012 | Deans et al. | 401/281 |
| 2004/0005187 | A1 * | 1/2004 | Bertothy | 401/281 |
| 2005/0175397 | A1 * | 8/2005 | Chen | 401/281 |
| 2007/0209675 | A1 * | 9/2007 | Byun | 132/299 |
| 2009/0041530 | A1 * | 2/2009 | Deans et al. | 401/269 |
| 2010/0288300 | A1 * | 11/2010 | Byun | 132/299 |

FOREIGN PATENT DOCUMENTS

KR 20-2001-0013002 10/2001

* cited by examiner

*Primary Examiner* — David J. Walczak
*Assistant Examiner* — Bradley Oliver
(74) *Attorney, Agent, or Firm* — Kaplan, Breyer, Schwarz & Ottesen, LLP

(57) ABSTRACT

Provided is a cosmetic brush. The cosmetic brush includes a cylindrical bottle, a body, a hair holder, a filter, a sleeve, and a cap. When makeup is applied, the sleeve descends. When the sleeve is stored, the sleeve ascends to easily close the cap. When the sleeve descends, a powder is supplied toward hairs. When the sleeve ascends (is stored), the supply of the powder is intercepted to prevent the powder from being unnecessarily discharged, thereby preventing other portable products from being damaged. Also, when the sleeve is stored, the sleeve blocks the powder discharge hole to prevent the powder remaining within the discharge hole from being hardened by moisture, thereby smoothly discharging the powder.

4 Claims, 25 Drawing Sheets

POWDER COSMETIC BRUSH

CROSS-REFERENCE TO RELATED APPLICATIONS

Korean patent application KR 10-2011-0119030, filed Nov. 15, 2011, is incorporated herein by reference.

FIELD OF THE INVENTION

The present invention relates to a powder cosmetic brush, and more particularly, to a powder cosmetic brush having a structure in which a sleeve for gathering hairs when a cap is closed is forwardly or reversely rotated together with a hair holder to maintain a powder discharge hole in an open state, thereby discharging powder from a bottle, or to maintain the powder discharge hole in a close state, thereby prevent the powder from being discharged.

DESCRIPTION OF THE RELATED ART

In general, cosmetics are classified into solid cosmetics and liquid cosmetics in which liquid cosmetics are adequately mixed. Recently, for user's convenience, cosmetics such as lipstick or foundation are being supplied in liquid type. That is, liquid cosmetics may be filled into a container having an approximate pencil shape. Then, when the cosmetics are used, a portion of the container may be rotated to discharge the cosmetics within the container into an upper portion of a cosmetic brush to make up.

In conventional cosmetic brushes used commonly, a brush is integrated with a body to use a brush coated with separate powder when makeup is applied. Since the powder and the brush are separately provided, it may be inconvenient to carry and store the powder and the brush. Accordingly, it is not easy to utilize the cosmetics.

Recently, various cosmetic brushes having a structure in which powder is received into a body having a container shape to discharge the powder received in the body toward a brush, thereby applying makeup are being proposed and used. This is disclosed in Korean Utility Model registration No. 0253672.

A conventional powder cosmetic brush includes a first body having a tube shape with upper and lower side opened, the first body receiving powder therein, a second body coupled to a lower outer surface of the first body and having a discharge hole in a central portion of a top surface thereof, the second body including a brush connected to the discharge hole on a front end thereof; a vertical transfer shaft coupled to a spring on an outer surface of a front end thereof, wherein the front end is coupled to the discharge hole of the second body and the spring is supported by an outer circumference of an upper end of the discharge hole, and an upper cap coupled to an upper end of the first body to allow the vertical transfer shaft to protrude to the upper outside, the upper cap supporting the vertical transfer shaft.

However, in the conventional powder cosmetic brush, the powder is discharged by the front end of the vertical transfer shaft. However, it may be inconvenient to constantly discharge the powder due to a structure of the vertical transfer shaft as well as to discharge the powder toward the brush due to shaking of the cosmetic brush itself.

Also, the conventional powder cosmetic brush has a structure in which a button disposed on the upper cap continuously protrudes outward by elasticity of the spring. Thus, when the powder cosmetic brush collides with other portable products during the carrying and storage or an external force is applied to the powder cosmetic brush, the button may be moved to unnecessarily discharge the powder to the brush, thereby damaging the other portable products. Also, when the powder cosmetic brush is stored in a wet state or is not used for a long time, the powder within the first body and the powder remaining within the discharge hole may be hardened by the moisture. Thus, it may be difficult to smoothly discharge the powder hardened by moisture.

Also, a cosmetic brush disclosed in U.S. Pat. No. 6,935,802 has a complicated structure in which a sleeve type protection cap is movably disposed on an inner operation body and an operation body is disposed on a lower portion of the sleeve type protection cap.

According to the conventional cosmetic brush, there are limitations that a structure for opening or closing the discharge hole for the powder is complicated and manufacturing costs are high.

SUMMARY OF THE INVENTION

Accordingly, the present invention is directed to a powder cosmetic brush that substantially obviates one or more problems due to limitations and disadvantages of the related art.

Accordingly, the present invention is directed to a powder cosmetic brush having a structure in which a sleeve gathers hairs when a cap is closed, a hair holder is rotated together by rotating the sleeve, and a powder discharge hold and a communication hole are maintained in an open state to discharge powder within a bottle or the powder discharge hole and the communication hole are maintained in a close state to prevent the powder within the bottle from being discharged, wherein the powder is discharged or not discharged by using the sleeve to simplify the close/open structure, thereby significantly reduce mold manufacturing costs.

According to an aspect of the present invention, there is provided a cosmetic brush including: a cylindrical bottle on which a male screw is disposed along an upper outer surface, the cylindrical bottle containing powder therein; a body in which a female screw is disposed on an inner bottom surface to be coupled to an upper portion of the cylindrical bottle, a through hole is defined in a center of a lower bottom surface thereof, a plurality of powder discharge holes are defined along an edge of the lower bottom surface, and a hook and a locking projection are disposed along an upper outer surface thereof; a hair holder inserted into the body and in which hairs are fixed to an upper portion thereof, a plurality of communication holes respectively communicating with the power discharge holes are defined in a lower portion thereof, and a wedge projection inserted into the through hole is disposed on a central bottom surface thereof; a filter inserted into the wedge projection to filter the powder passing through the powder discharge holes; a sleeve disposed to be vertically slidable along an outer surface of the hair holder, the sleeve being coupled to the hair holder so that the communication holes respectively match the powder discharge holes to open the communication hole; and a cap supported by the hook, the cap being detachably coupled to an upper portion of the body, wherein the sleeve gathers the hairs when the cap is closed and the hair holder is rotated together with the sleeve to match the power discharge holes with the communication holes, thereby maintaining an open state and discharging the powder within the bottle or mismatch the power discharge holes with the communication holes, thereby maintaining an close state and preventing the powder within the bottle from being discharged.

A hook groove may be horizontally defined in an upper outer surface of the hair holder, a dropping down prevention hook may be disposed on a lower outer surface of the hair holder, a fixing groove may be vertically disposed on an outer surface of the hair holder, a hook projection may be disposed on a lower portion of the sleeve to correspond (coupled) to the hook groove and the dropping down prevention hook, and a fixing projection may be disposed on the lower portion of the sleeve to correspond to the fixing groove.

A locking hook locked with a bottom surface of the body may be disposed on a lower portion of the hair holder, and an O-ring may be disposed on a bottom surface of the hair holder.

A stopper may be disposed on a bottom surface of the body, and a key rod may be disposed on a lower portion of the hair holder so that the key rod is selectively hooked on the stopper.

DETAILED DESCRIPTION OF THE INVENTION

Figure 1:
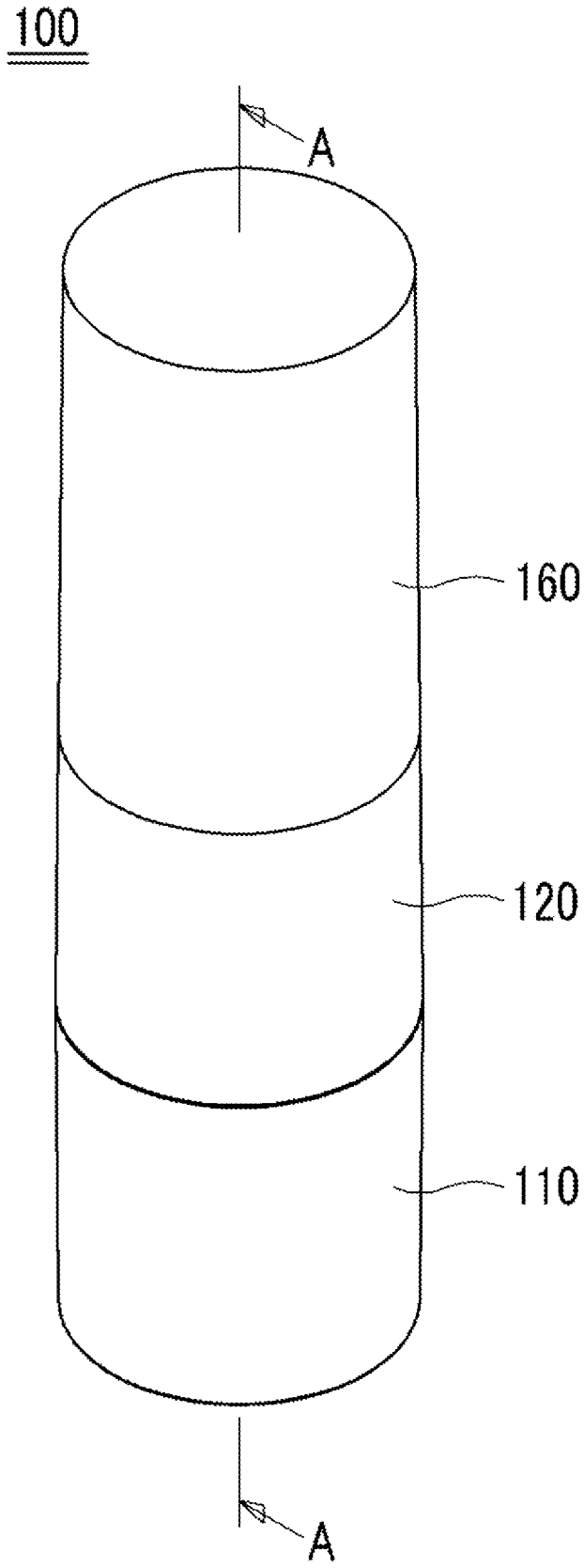
FIG. 1 is a perspective view of a powder cosmetic brush in a state where a cap is closed according to an embodiment of the present invention.

Reference will now be made in detail to the preferred embodiments of the present invention, examples of which are illustrated in the accompanying drawings. Wherever possible, the same reference numbers will be used throughout the drawings to refer to the same or like parts.

Hereinafter, a powder cosmetic brush according to an embodiment of the present invention will be described in detail with reference to the accompanying drawings.

Referring to FIGS. 1 to 25, a powder cosmetic brush 100 according to an embodiment of the present invention includes a cylindrical bottle 110 on which a male screw 112 is disposed along an upper outer surface, the cylindrical bottle 110 containing powder therein, a body 120 in which a female screw 121 is disposed on an inner bottom surface to be coupled to an upper portion of the cylindrical bottle 110, a through hole 122 is defined in a center of a lower bottom surface thereof, a plurality of powder discharge holes 123 are defined along an edge of the lower bottom surface, and a hook 124 and a locking projection 125 are disposed along an upper outer surface thereof, a hair holder 130 inserted into the body 120 and in which hairs H are fixed to an upper portion thereof, a plurality of communication holes 131 respectively communicating with the power discharge holes 123 are defined in a lower portion thereof, and a wedge projection 132 inserted into the through hole 122 is disposed on a central bottom surface thereof, a filter 140 inserted into the wedge projection 132 to filter the powder passing through the powder discharge holes 123, a sleeve 150 disposed to be vertically slidable along an outer surface of the hair holder 130, the sleeve 150 being coupled to the hair holder 130 so that the communication holes 131 respectively match the powder discharge holes 123 to open the communication hole 131, and a cap 160 supported by the hook 124, the cap 160 being detachably coupled to an upper portion of the body 120.

Hereinafter, the powder cosmetic brush according to the embodiment of the present invention will be described in more detail.

The bottle 110 has a cylindrical shape with a lower side closed and an upper side opened. A space for receiving the powder is defined in the bottle 110. The male screw 112 (see FIGS. 3 to 5) is disposed along the upper outer surface of the bottle 110.

Also, the female screw 121 (see FIGS. 3 to 5) is disposed on the inner bottom surface of the body 120 so that the body 120 is coupled to the upper portion of the bottle 110.

The through hole 121 is defined in the center of the lower bottom surface of the body. Also, the plurality of powder discharge holes 123 are defined along an edge of the lower bottom surface of the body 120. The hook 124 and the locking projection 125 are disposed on an upper outer surface of the body 120 (see FIG. 13).

A stopper 128 protrudes from a bottom surface of the body 120. A key rod 138 (see FIG. 16) is disposed on the hair holder 130 so that the key rod 138 is selectively hooked on the stopper 128 (see FIG. 13).

The hair holder 130 is inserted into the body 120, and the hairs H is fixed to an upper portion of the hair holder 130. Also, a plurality of communication holes 131 respectively communicating with the powder discharge holes 123 are defined in the lower portion of the hair holders 130 (see FIGS. 3 to 15).

Figure 14:
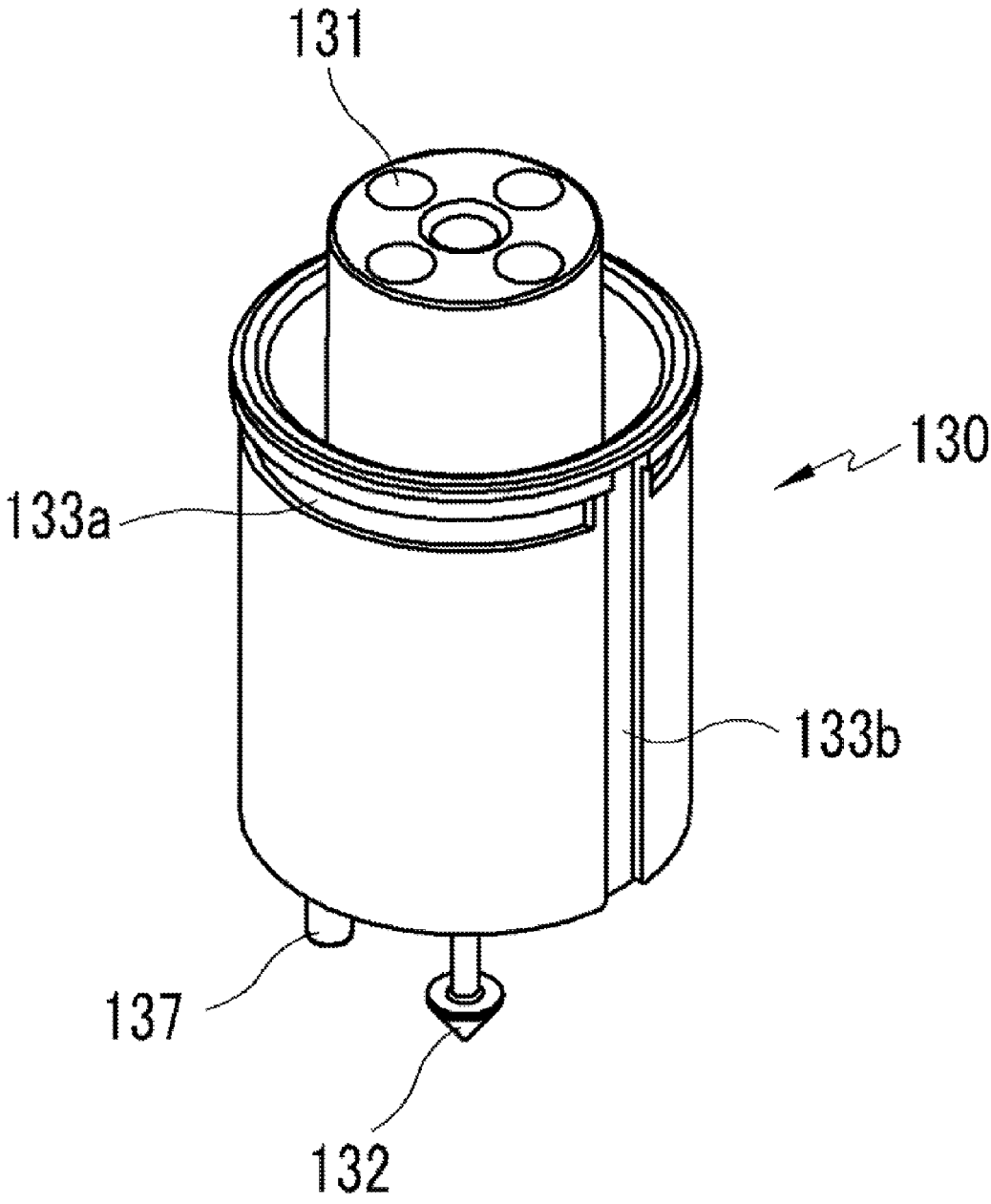
FIG. 14 is a perspective view of a brush holder.
Figure 15:
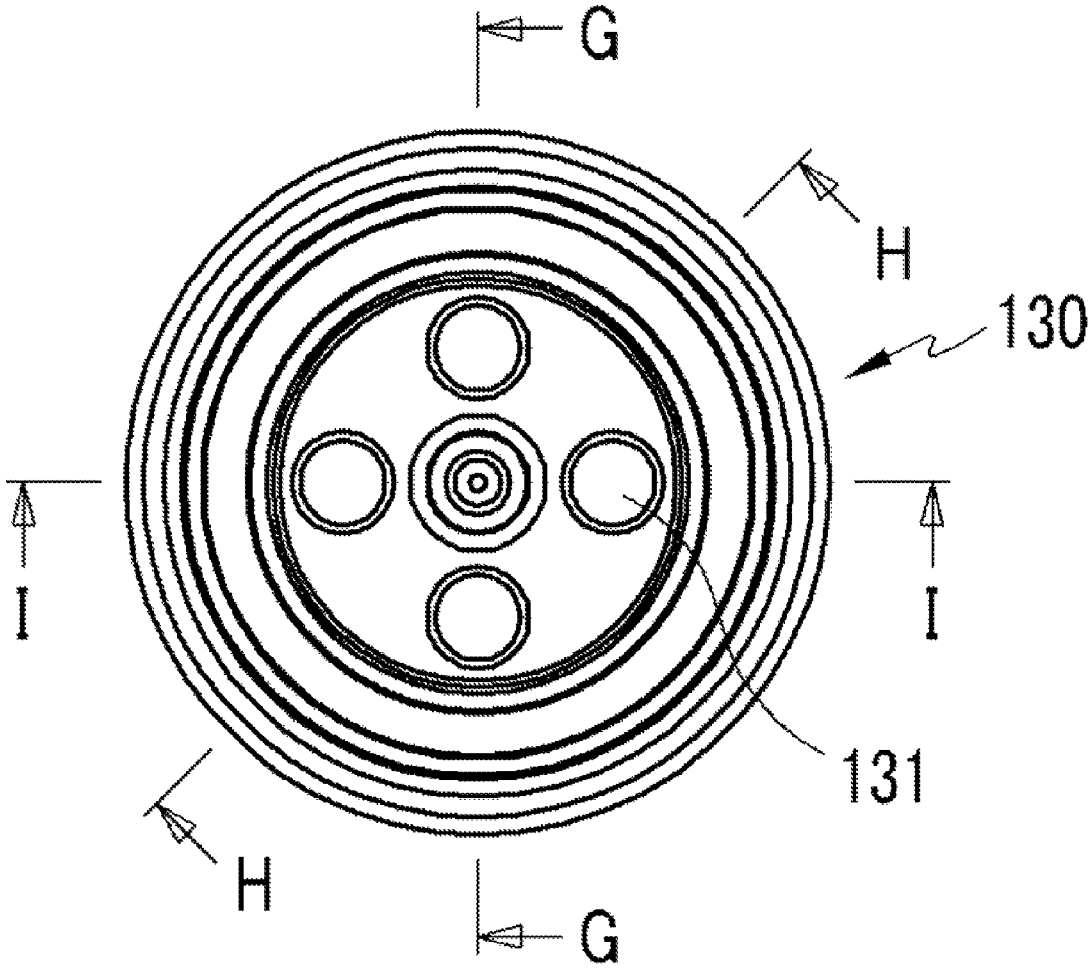
FIG. 15 is a plan view of the brush holder.
Figure 16:
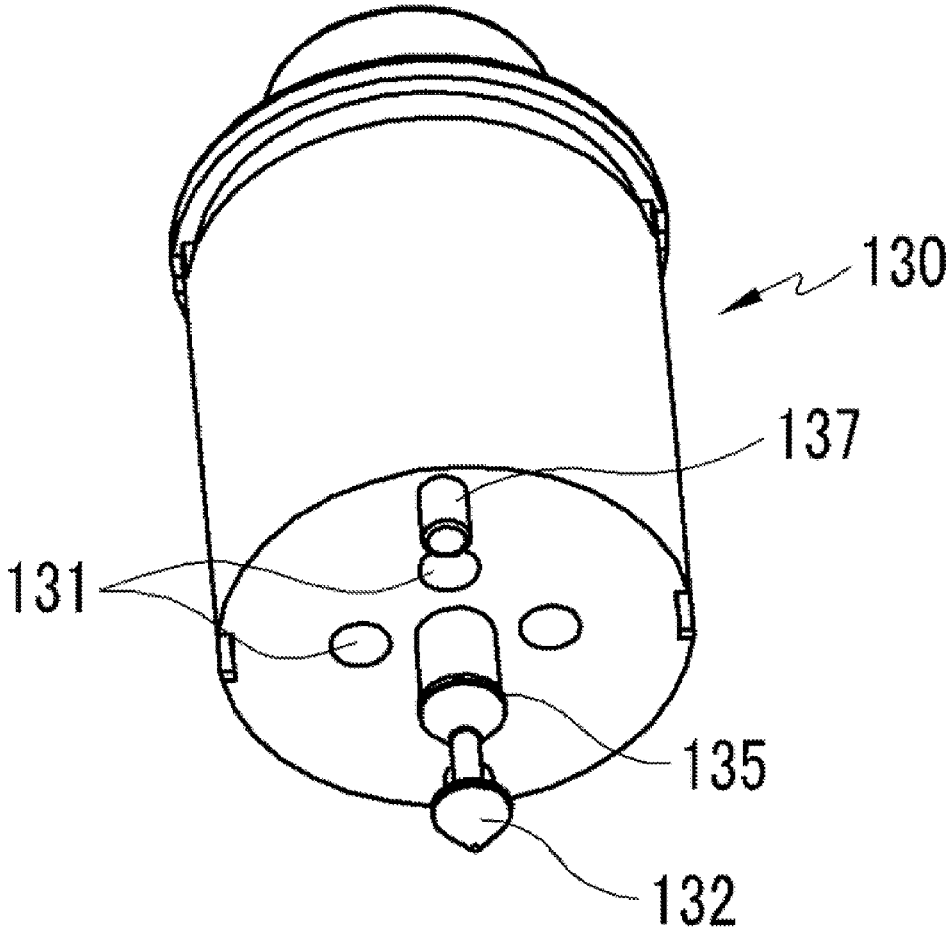
FIG. 16 is a bottom perspective view of the brush holder.
Figure 17:
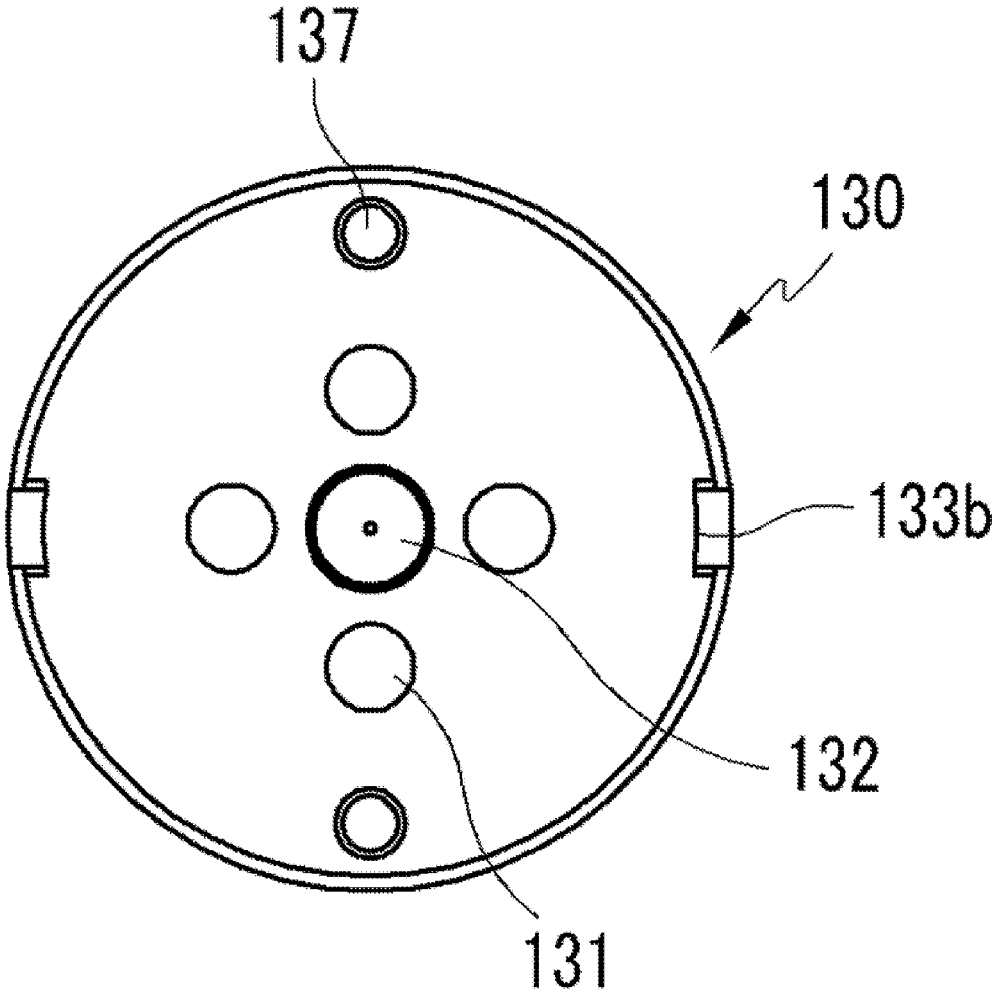
FIG. 17 is a bottom view of the brush holder.

The wedge projection 132 inserted into the through hole 122 is disposed on a central bottom surface of the hair holder 130 (see FIGS. 14 to 16).

A dropping down prevention groove 133*a* and a guide groove 133*b* are defined in an upper outer surface of the hair holder 130. Also, a dropping down prevention hook 134 is disposed on a lower outer surface of the hair holder 130 (see FIGS. 14 and 18).

Figure 10:
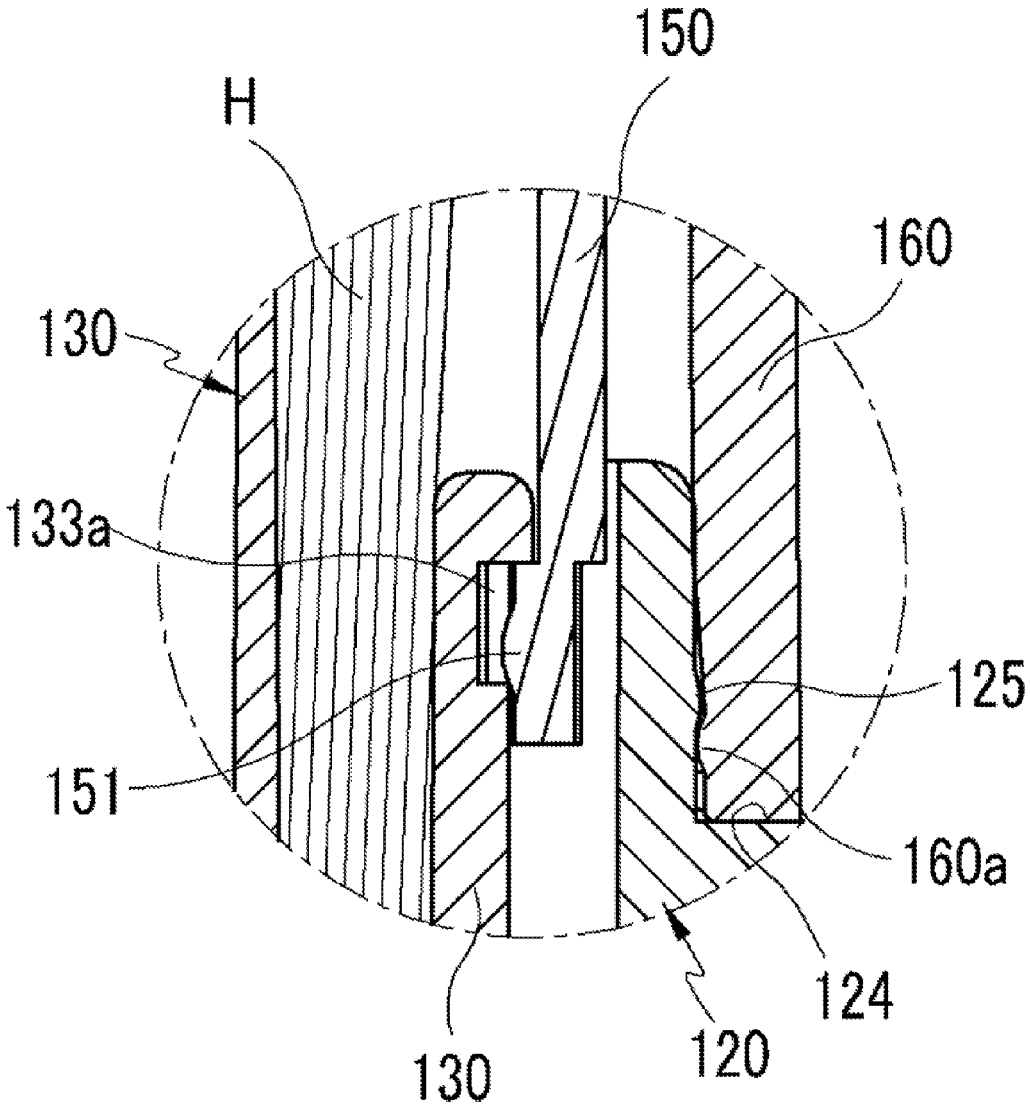
FIG. 10 is an enlarged view illustrating a region E of FIG. 3.
Figure 11:
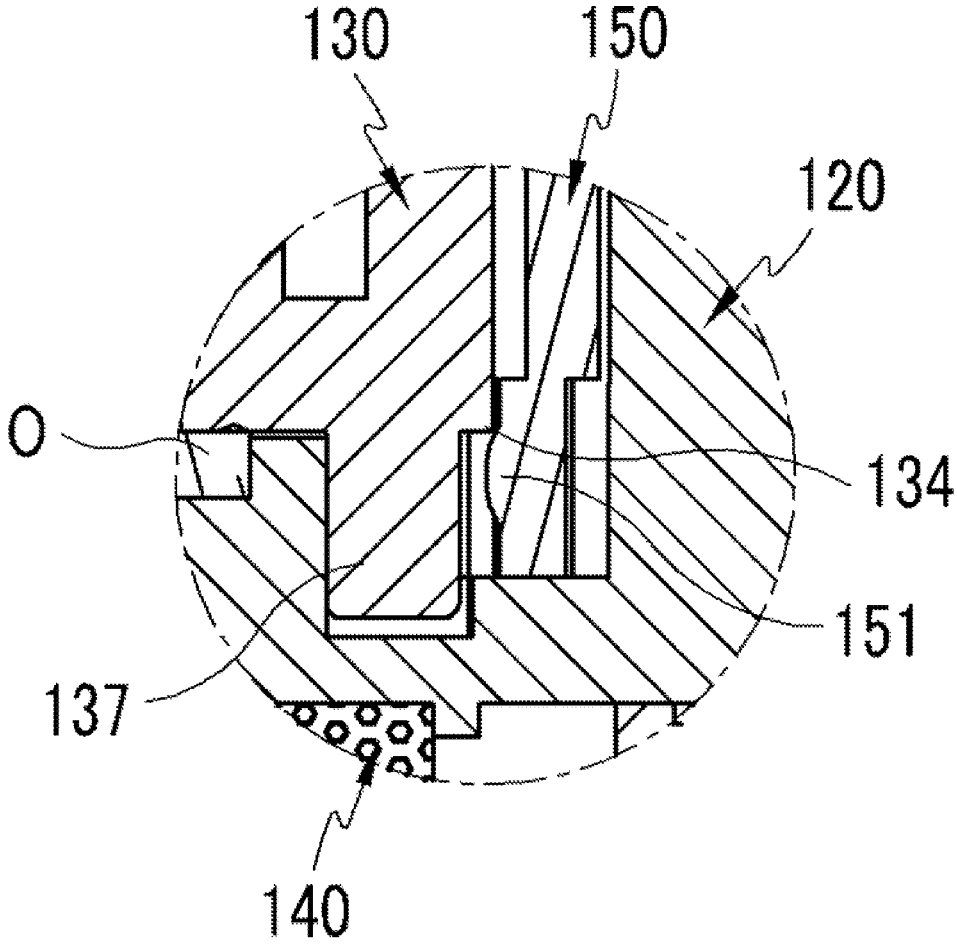
FIG. 11 is an enlarged view illustrating a region F of FIG. 5.
Figure 12:
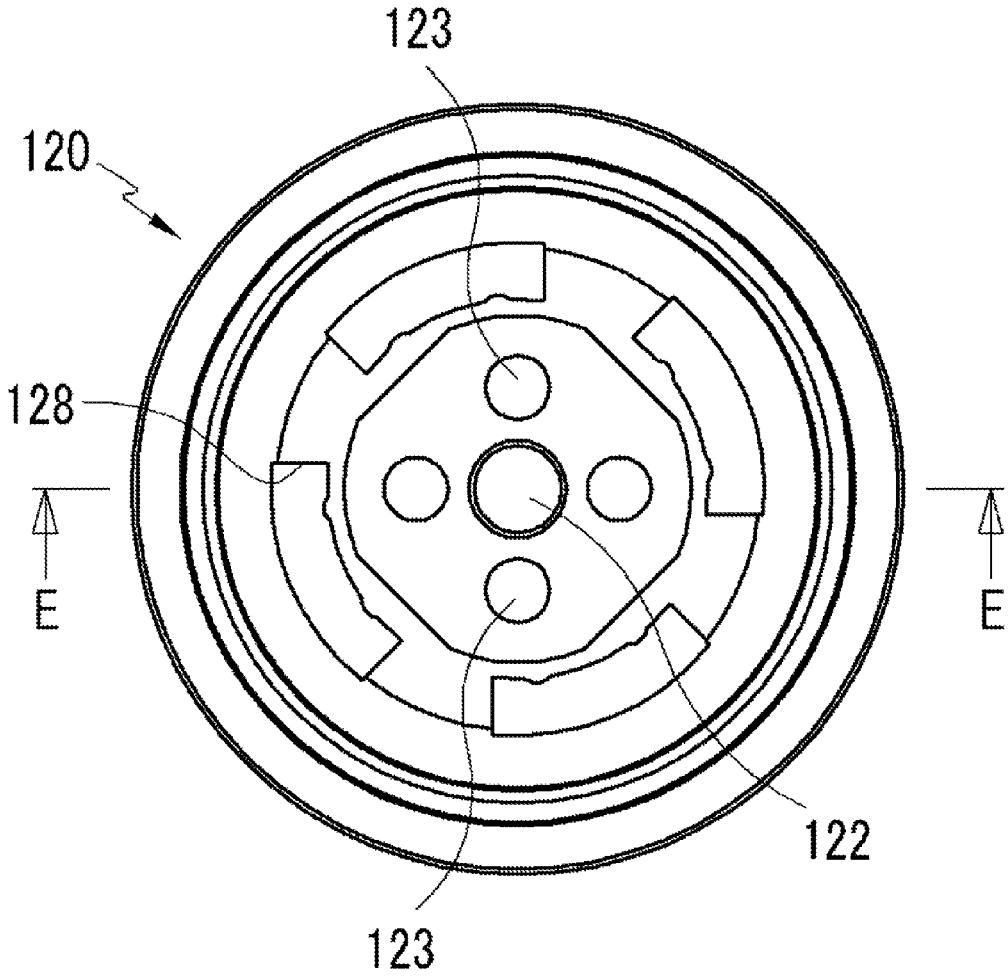
FIG. 12 is a plan view of a body.
Figure 13:
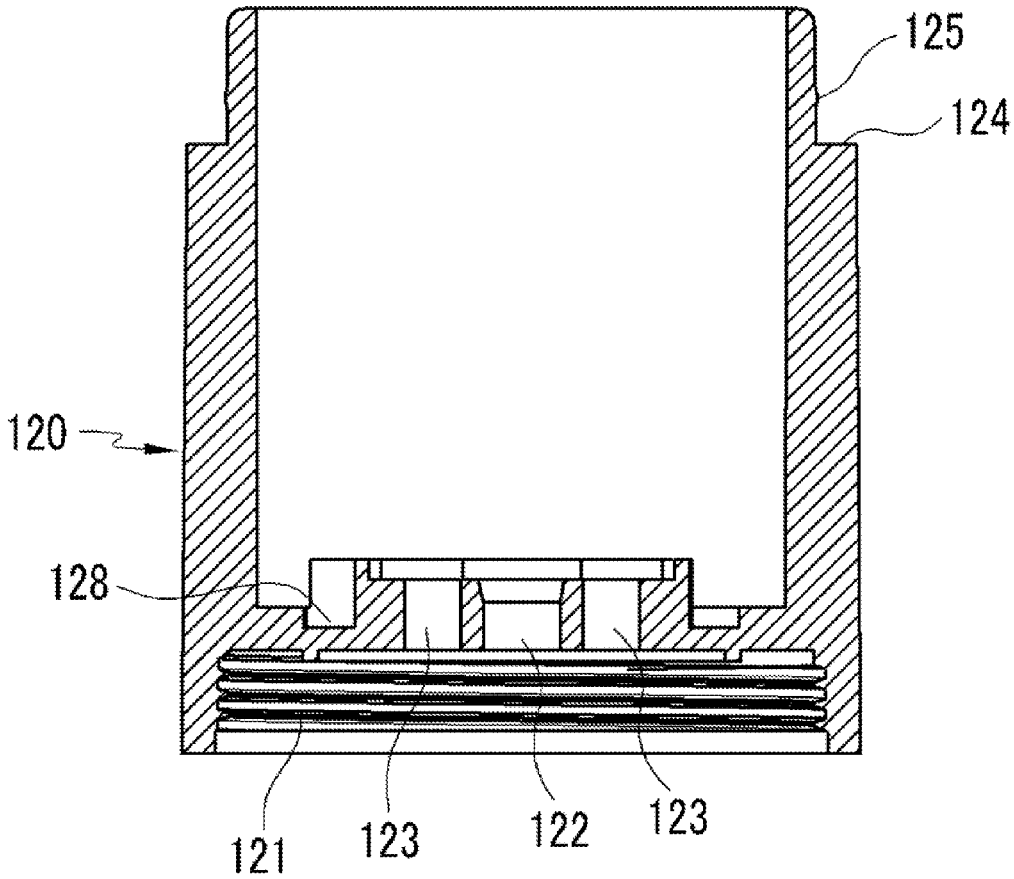
FIG. 13 is a sectional view of the body.
Figure 21:
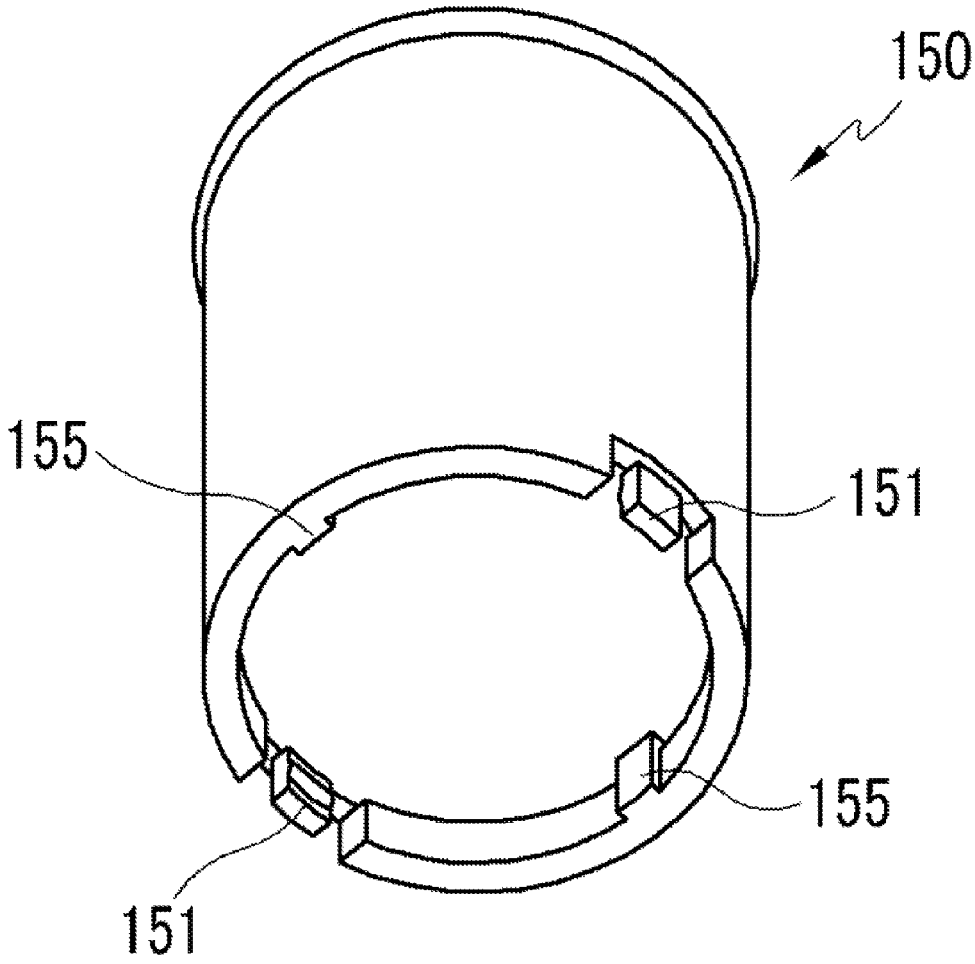
FIG. 21 is a bottom perspective view of the sleeve.
Figure 22:
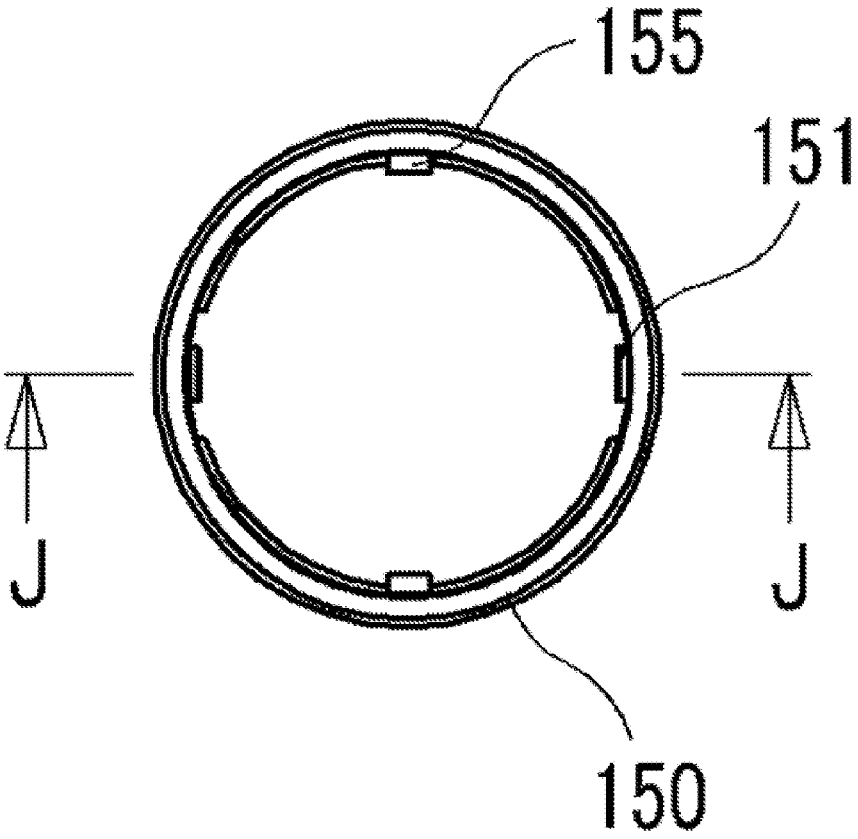
FIG. 22 is a plan view of the sleeve.
Figure 23:
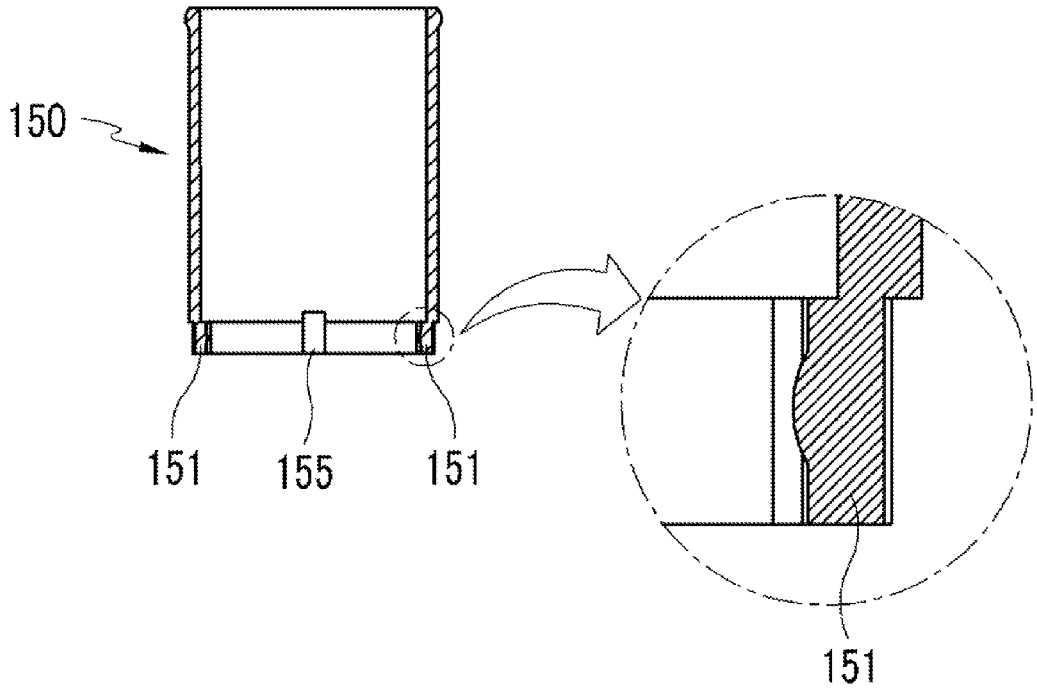
FIG. 23 is a sectional view taken along line J-J of FIG. 22.
Figure 24:
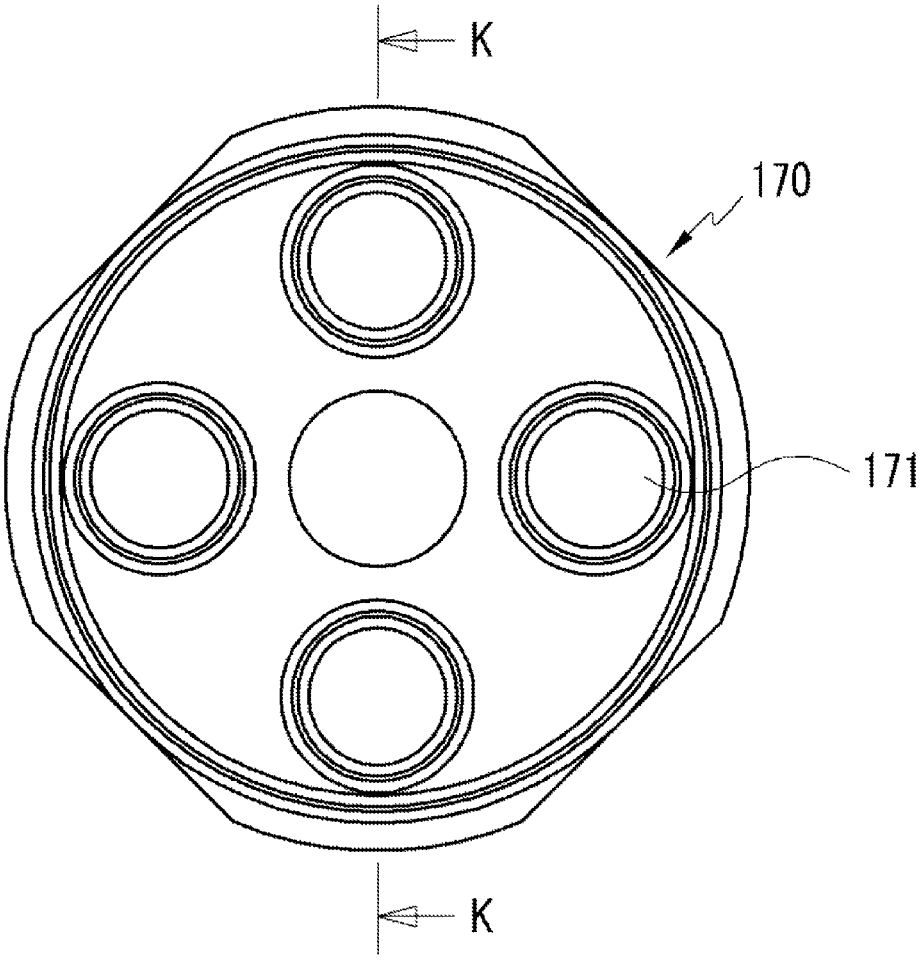
FIG. 24 is a plan view of an O-ring.
Figure 25:
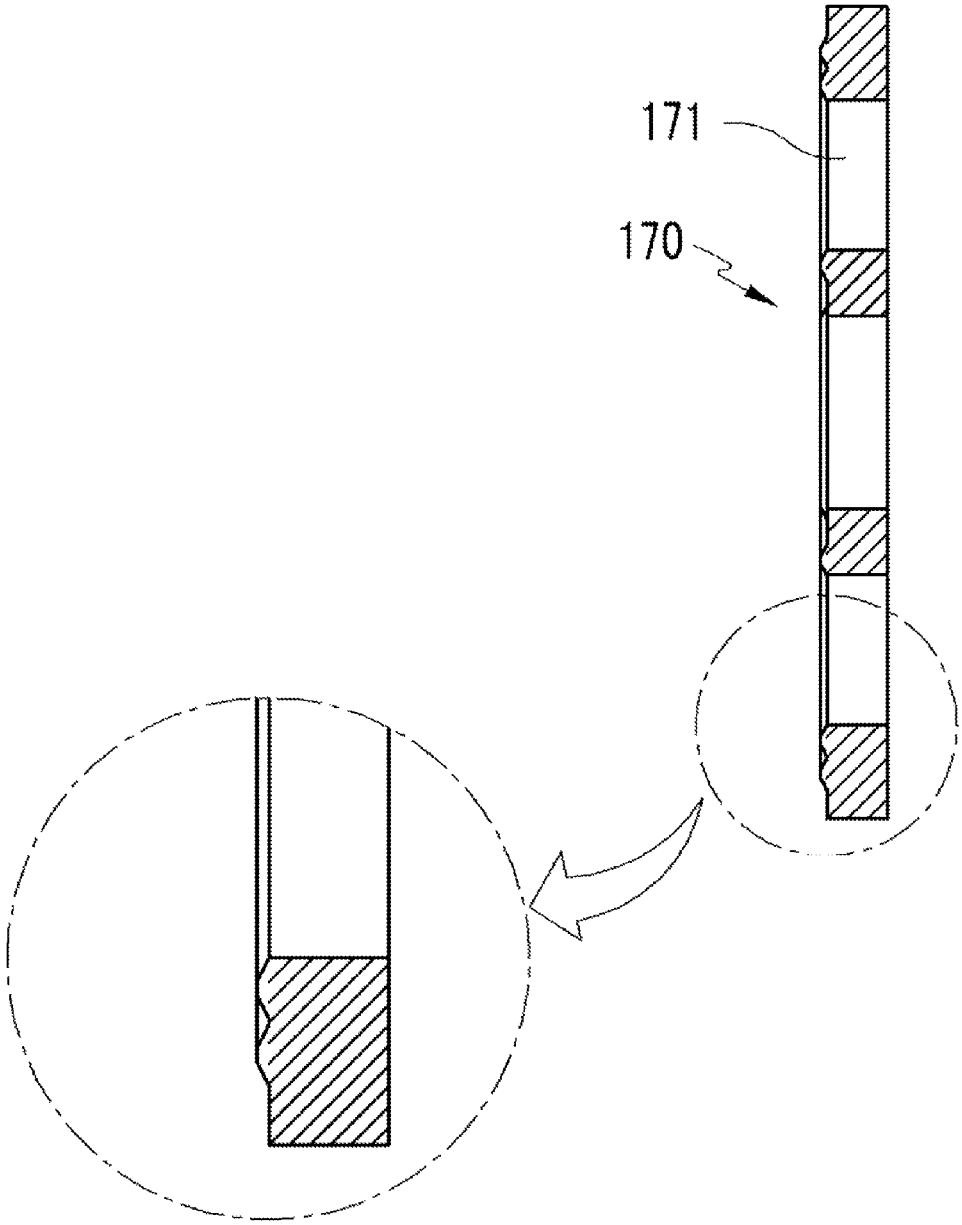
FIG. 25 is a cross-sectional view taken along line K-K of FIG. 24.

A dropping down prevention projection 151 is disposed on a lower inner surface of the sleeve 150 to correspond to the dropping down prevention groove 133*a*, the guide groove 133*b*, and the dropping down prevention hook 134 (see FIGS. 10 and 21).

Figure 18:
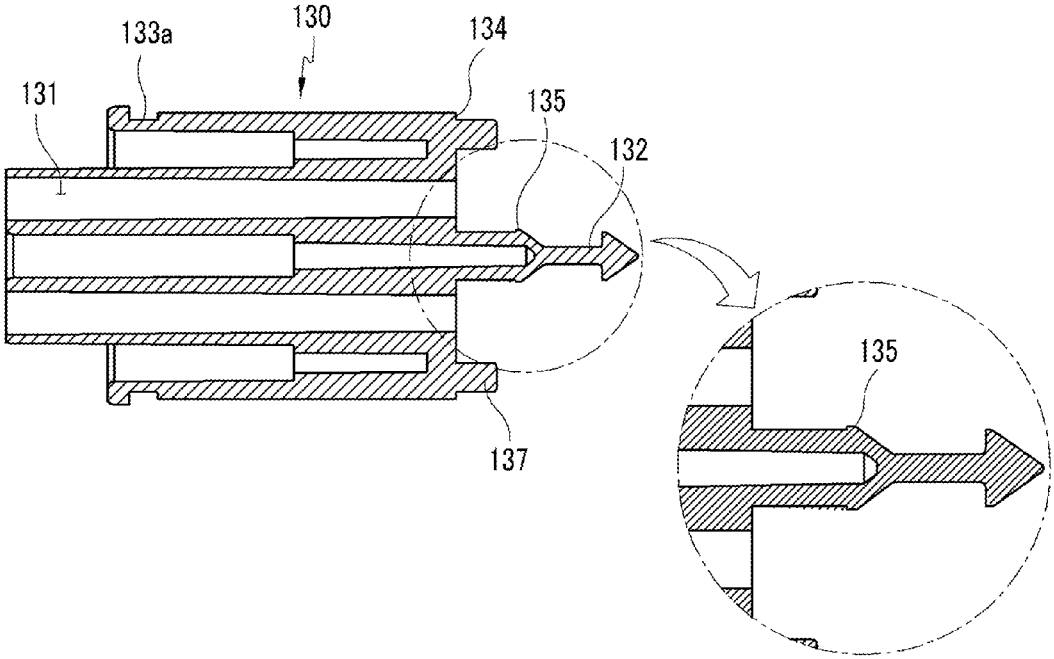
FIG. 18 is a sectional view taken along line C-C of FIG. 14.
Figure 19:
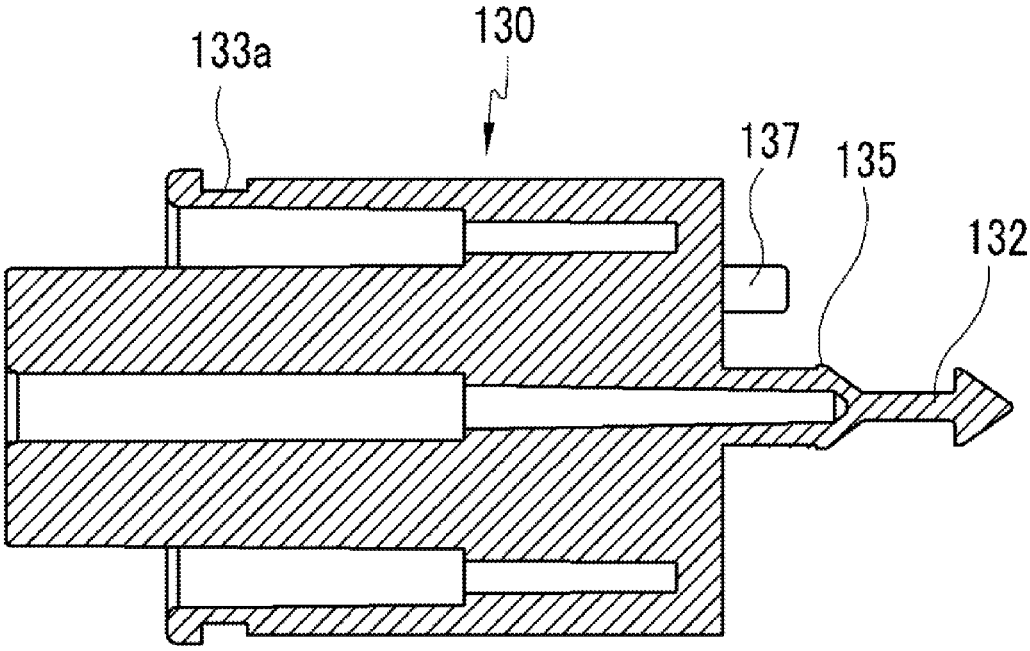
FIG. 19 is a cross-sectional view taken along line H-H of FIG. 15.
Figure 20:
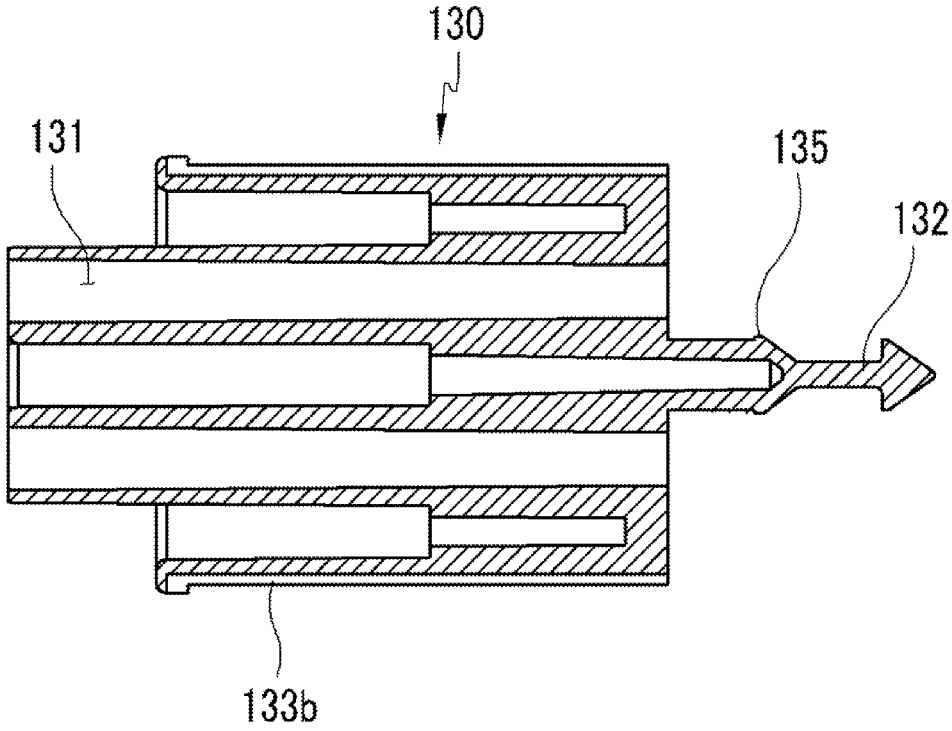
FIG. 20 is a sectional view taken along line I-I of FIG. 16.

A locking hook 135 locked with a bottom surface of the body 120 is disposed on a lower portion of the hair holder 130, and an O-ring 170 is disposed between the hair holder 130 and the body 120 (see FIGS. 18 and 19). A hole 171 of the O-ring 170 is defined to constantly communicate with the discharge holes 123 of the body 120 (see FIGS. 3, 19, and 24).

The filter 140 filters the powder so that the powder is supplied at a predetermined amount through the powder discharge holes 123. Also, the filter 140 is inserted into the wedge projection 132 (see FIGS. 3 to 5).

The sleeve 150 is disposed to be vertically slidable along the outer surface of the hair holder 130. When the sleeve 150 is forwardly or reversely rotated, the hair holder 130 linked with the sleeve 150 is forwardly or reversely rotated also. Thus, the powder discharge holes 123 and the communication holes 131 may be closed (see FIG. 8) or opened (see FIG. 9) together with each other. Here, the forward direction represents a direction (clockwise direction) in which the powder discharge holes 123 are closed, and the reverse direction represents a direction (counterclockwise direction) in which the power discharge holes 123 are opened (see FIGS. 8 and 9).

The cap 160 is supported by the hook 124 and detachably coupled to the upper portion of the hair holder 130. A hook projection 160 (see FIG. 10) corresponding to the locking projection 125 is disposed on an inner surface of the cap 160.

Hereinafter, an operation of the powder cosmetic brush 100 according to the embodiment of the present invention will be described in more detail.

Figure 2:
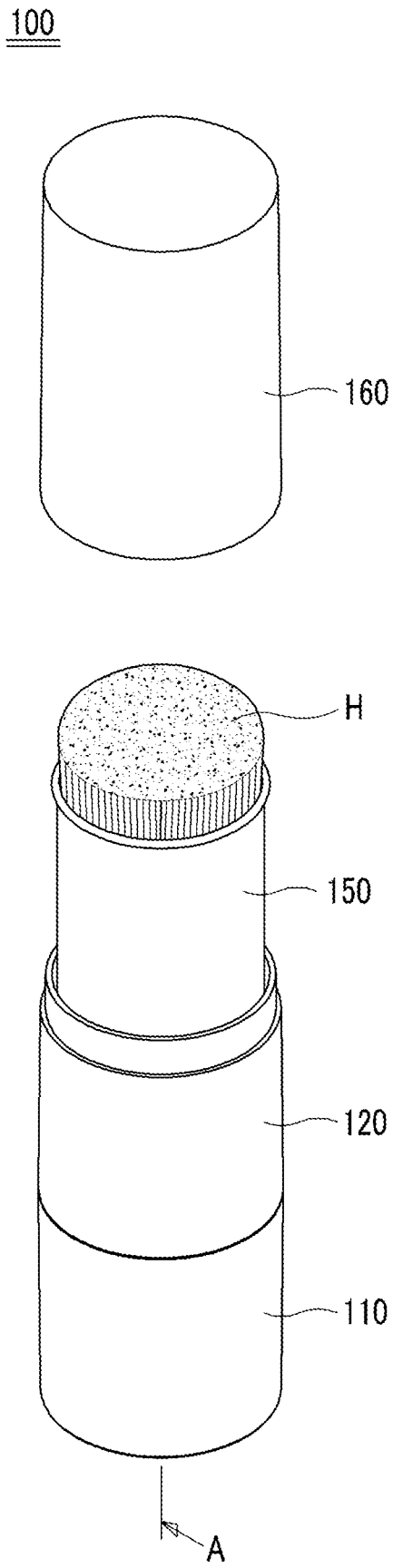
FIG. 2 is a perspective view of the powder cosmetic brush in a state where the cap is opened according to an embodiment of the present invention.
Figure 3:
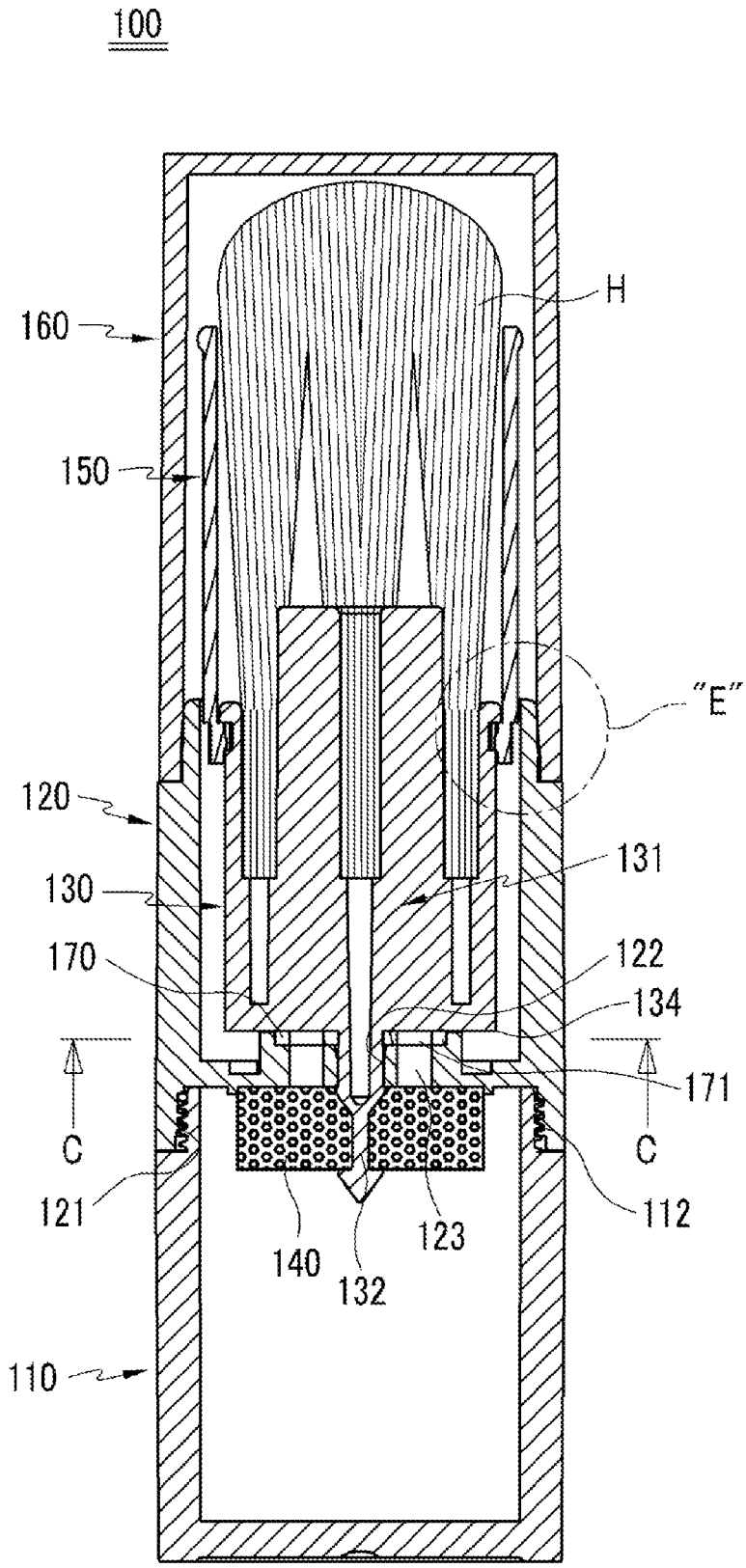
FIG. 3 is a sectional view taken along line A-A of FIG. 1 in a state where a powder discharge hole is closed.
Figure 4:
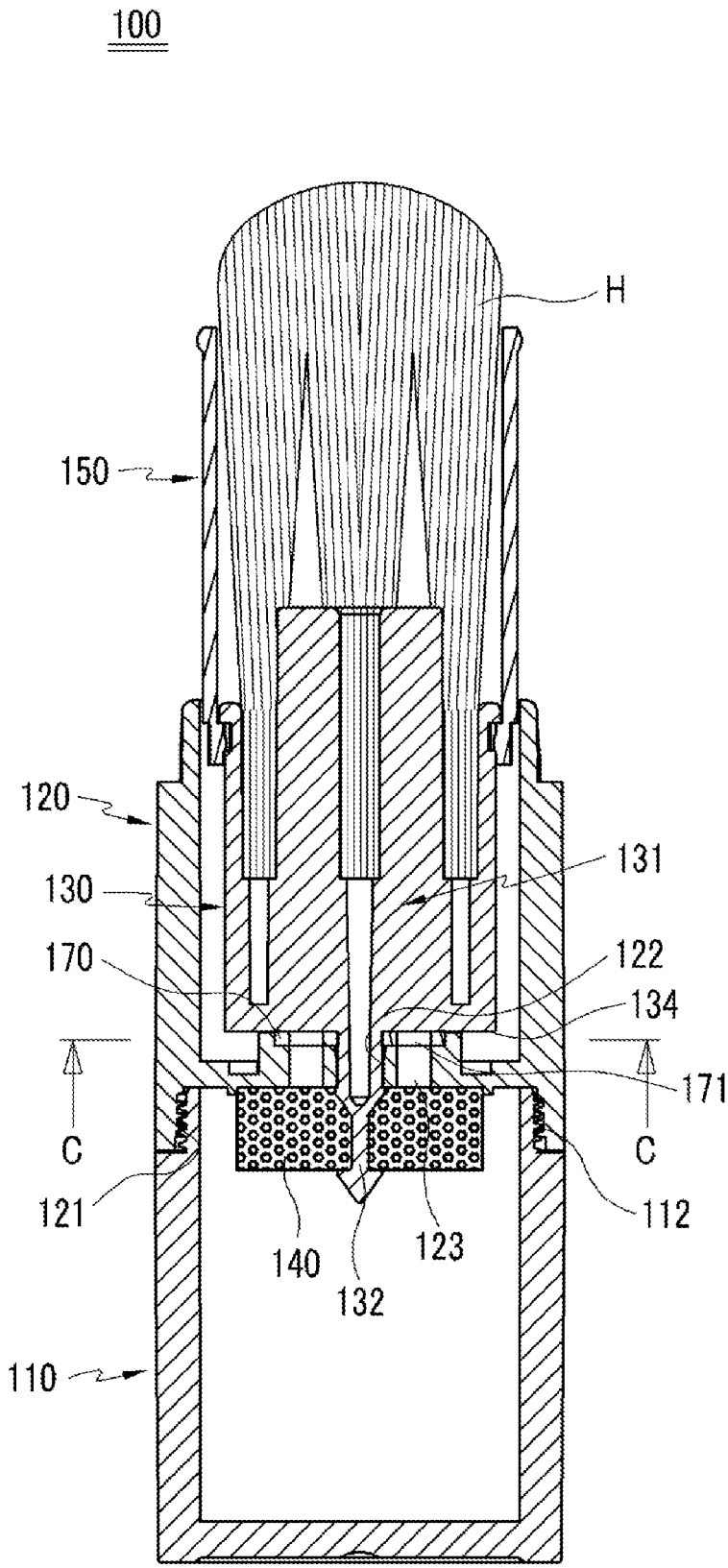
FIG. 4 is a sectional view taken along line A-A of FIG. 1 in a state where a powder discharge hole is opened.
Figure 5:
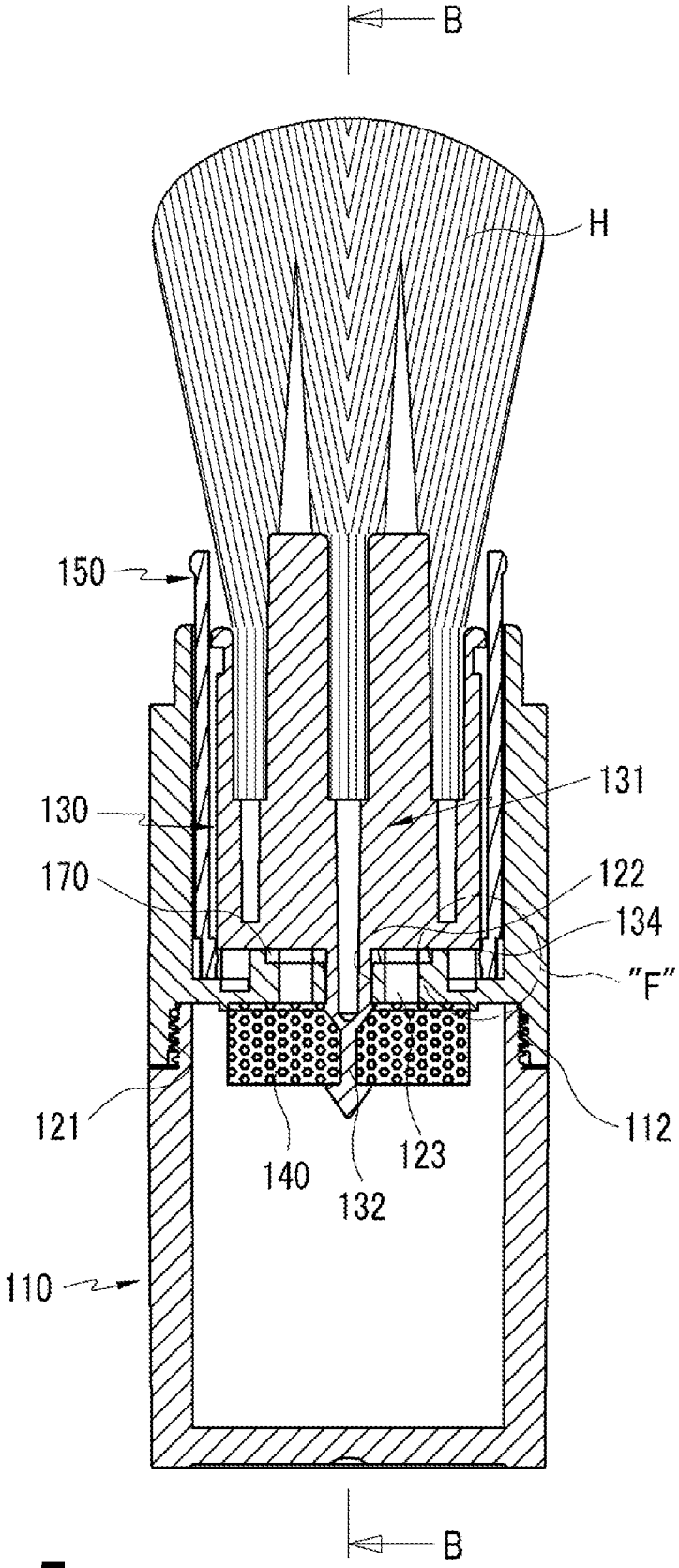
FIG. 5 is a view of a state in which a sleeve falls down in FIG. 4.

FIGS. 2 and 4 illustrate a state in which the powder cosmetic brush 100 is closed. Here, the sleeve 150 ascends to close the cap 160 gathering the hairs H.

Here, the dropping down prevention projection 151 disposed on the lower inner surface of the sleeve 150 is inserted into the dropping down prevention groove 133*a* defined in the upper outer surface of the hair holder 130 to fix the sleeve 150 in position.

Also, when the sleeve 150 is rotated at an angle of about 45° in the forward direction, the hair holder 130 linked with the sleeve 150 is rotated also at an angle of about 45° in the forward direction.

The key rod 137 is intercepted by the stopper 128 of the body 120. Here, the rotation of the hair holder 130 is completed. Here, the powder discharge holes 123 and the communication holes 131 are closed to prevent the powder within the bottle 110 from being supplied toward the hairs H (see FIG. 7).

Figure 6:
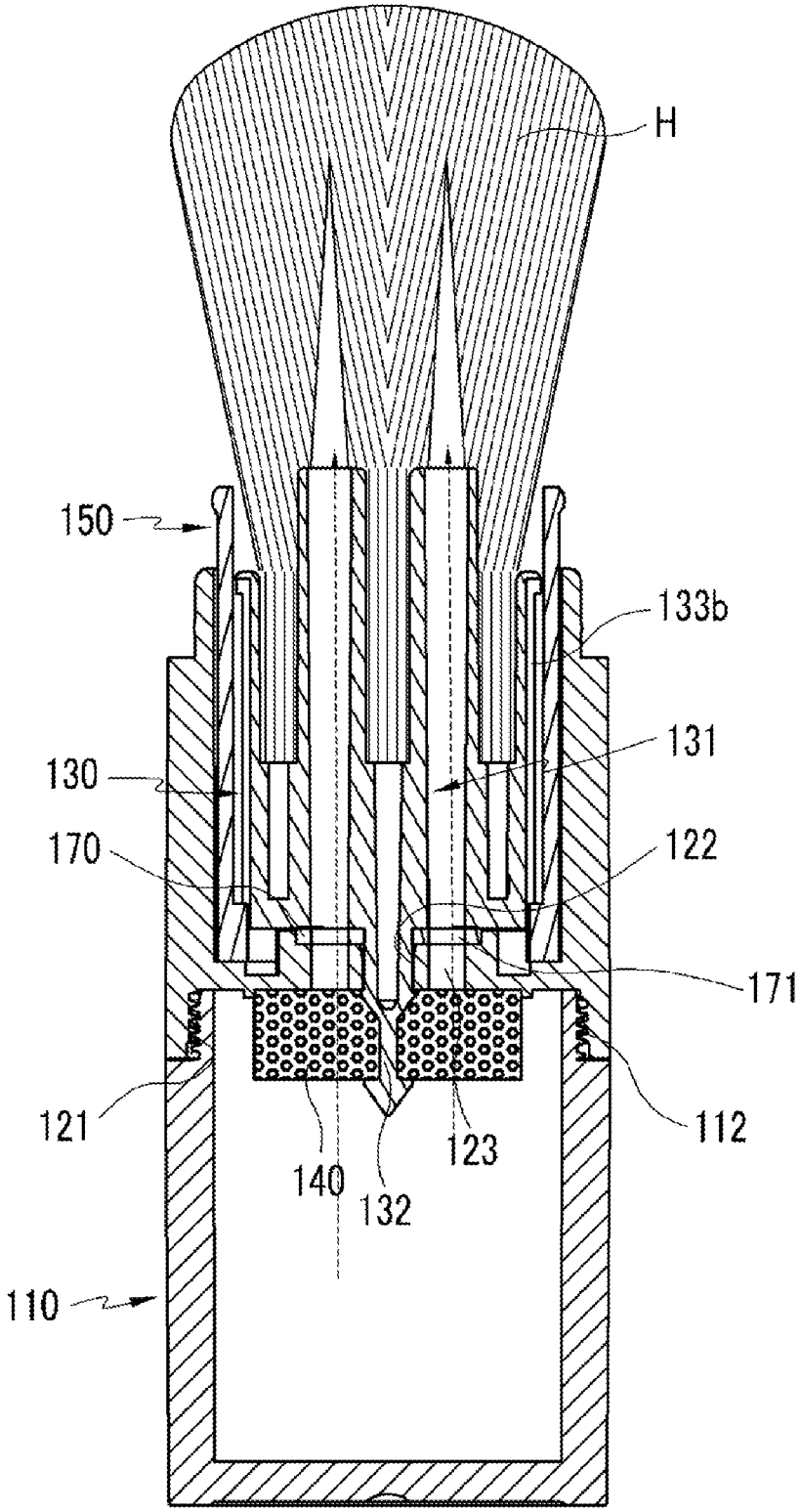
FIG. 6 is a sectional view taken along line B-B of FIG. 5 in a state where the powder discharge hole is opened.
Figure 7:
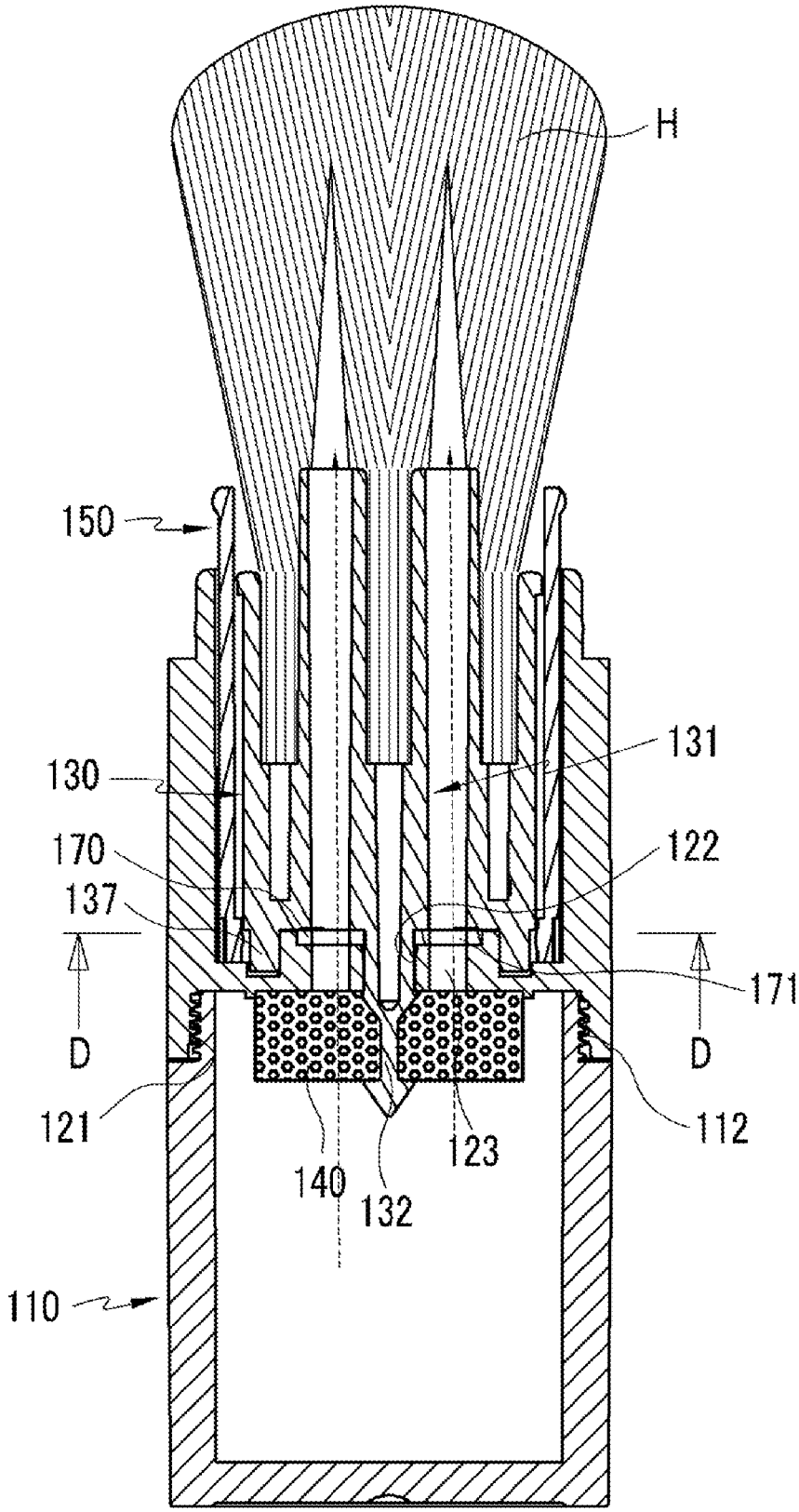
FIG. 7 is a sectional view of a fixing groove.
Figure 8:
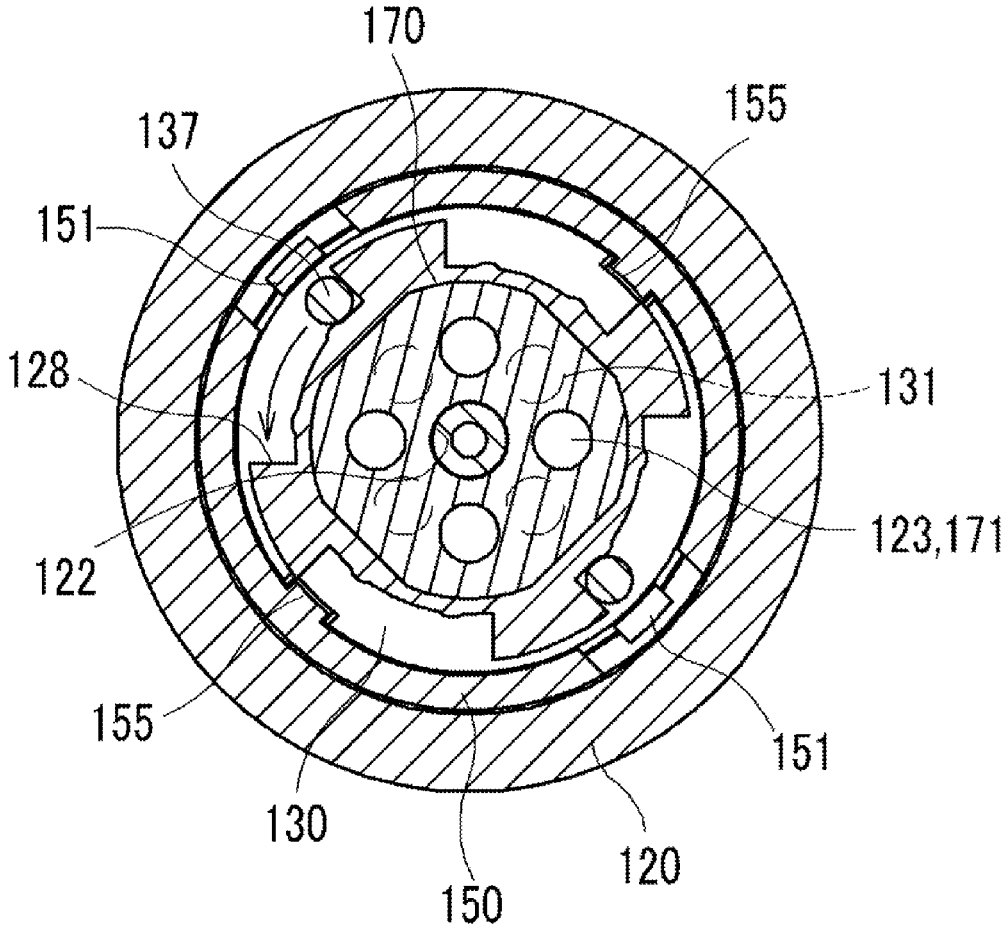
FIG. 8 is a sectional view taken along line C-C of FIG. 4.

FIG. 6 illustrates a state in which the powder cosmetic brush 100 is opened. Here, the cap 160 is opened to allow the sleeve 150 to descend. Here, the dropping down prevention projection 151 is moved downward along the guide groove 133*b*. The sleeve 150 is rotated in the reverse direction.

Figure 9:
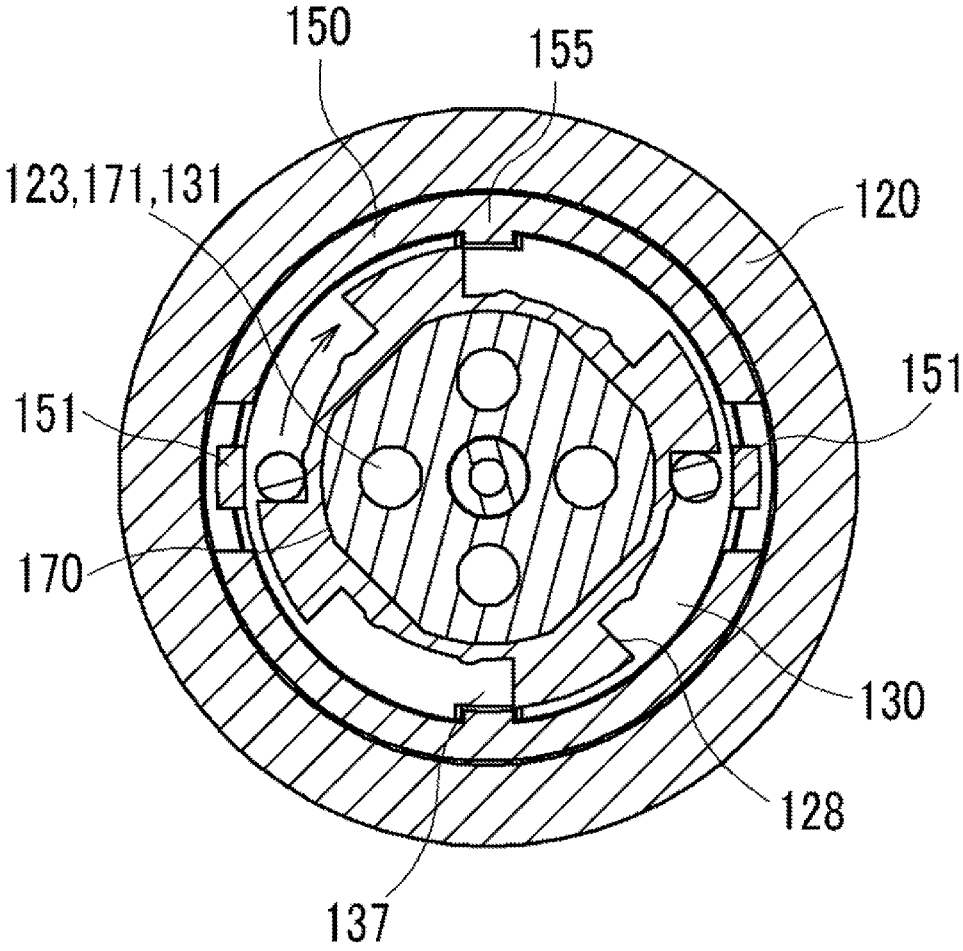
FIG. 9 is a cross-sectional view taken along line D-D of FIG. 6.

Here, the powder discharge holes 123 and the communication holes 131 are opened to supply the powder within the bottle 110 into the hairs H (see FIG. 9).

In the state when the sleeve 150 descends, the dropping down prevention projection 151 is hooked on the dropping down prevention projection 151 to fix the sleeve 150 in position.

The powder discharge holes 123 and the communication holes 131 are opened to supply the powder within the bottle 110, thereby applying makeup in the state where the sleeve 150 is fixed in position.

As described above, the hair holder may be rotated by rotating the sleeve. Here, the powder discharge hole and the communication hole may be maintained in the open state to discharge the powder within the bottle. On the other hand, the powder discharge hole and the communication hole may be maintained in the close state to prevent the powder within the bottle from being discharged. Also, the powder may be discharged or not discharged by using the sleeve. Therefore, the close/open structure may be simplified to significantly reduce the mold manufacturing costs.

As described above, the hair holder may be rotated by rotating the sleeve. Here, the powder discharge hole and the communication hole may be maintained in the open state to discharge the powder within the bottle. On the other hand, the powder discharge hole and the communication hole may be maintained in the close state to prevent the powder within the bottle from being discharged. Also, the powder may be discharged or not discharged by using the sleeve. Therefore, the close/open structure may be simplified to significantly reduce the mold manufacturing costs.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A cosmetic brush comprising:

a cylindrical bottle (110) on which a male screw (112) is disposed along an upper outer surface, the cylindrical bottle (110) being capable of containing powder therein;

a body (120) in which a female screw (121) is disposed on an inner bottom surface to be coupled to an upper portion of the cylindrical bottle (110), a through hole (122) is defined in a center of a lower bottom surface thereof, a plurality of powder discharge holes (123) are defined along an edge of the lower bottom surface, and a hook (124) and a locking projection (125) are disposed along an upper outer surface thereof;

a hair holder (130) inserted into the body (120) and in which hairs (H) are fixed to an upper portion thereof, a plurality of communication holes (131) respectively communicating with the powder discharge holes (123) are defined in a lower portion thereof, and a wedge projection (132) inserted into the through hole (122) is disposed on a central bottom surface thereof;

a filter (140) inserted into the wedge projection (132) to filter the powder passing through the powder discharge holes (123), the filter (140) being disposed against the lower bottom surface of the body (120) such that the filter (140) is in communication with the powder discharge holes (123);

a sleeve (150) disposed to be vertically slidable along an outer surface of the hair holder (130), the sleeve (150) being coupled to the hair holder (130) so that the communication holes (131) respectively match the powder discharge holes (123) to open the communication hole (131); and a cap (160) supported by the hook (124), the cap (160) being detachably coupled to an upper portion of the body (120), wherein the sleeve (150) gathers the hairs (H) when the cap is closed and the hair holder (130) is rotated together with the sleeve (150) to match the power discharge holes (123) with the communication holes (131), thereby maintaining an open state and discharging the powder within the bottle (110) or mismatch the power discharge holes (123) with the communication holes (131), thereby maintaining an close state and preventing the powder within the bottle (110) from being discharged.

2. The cosmetic brush of claim 1, wherein a hook groove (133*a*) is horizontally defined in an upper outer surface of the hair holder (130), a dropping down prevention hook (134) is disposed on a lower outer surface of the hair holder (130), a fixing groove (133*b*) is vertically disposed on an outer surface of the hair holder (130), a hook projection (151) is disposed on a lower portion of the sleeve (150) to correspond to the hook groove (133*a*) and the dropping down prevention hook (134), and a fixing projection (155) is disposed on the lower portion of the sleeve (150) to correspond to the fixing groove (133*b*).

3. The cosmetic brush of claim 1, wherein a locking hook (135) locked with a bottom surface of the body (12) is disposed on a lower portion of the hair holder (130), and an O-ring (170) is disposed on a bottom surface of the hair holder (130).

4. The cosmetic brush of claim 1, wherein a stopper (128) is disposed on a bottom surface of the body (120), and a key rod (137) is disposed on a lower portion of the hair holder (130) so that the key rod (137) is selectively hooked on the stopper (128).

* * * * *